United States Patent [19]

Walstra et al.

[11] 4,331,615

[45] May 25, 1982

[54] FUEL SUPPLY SYSTEM WITH AUTOMATIC CHOKE

[75] Inventors: Hidde Walstra, Almelo; Jaap Vonk, Enter, both of Netherlands

[73] Assignee: Texas Instruments Incorporated, Dallas, Tex.

[21] Appl. No.: 204,690

[22] Filed: Nov. 6, 1980

[51] Int. Cl.[3] ..... F02M 1/12

[52] U.S. Cl. ..... 261/39 C; 261/39 E; 236/101 C

[58] Field of Search ..... 261/39 C, 39 E; 236/101 C

[56] References Cited

U.S. PATENT DOCUMENTS

| | | | |
|---|---|---|---|
| 2,403,720 | 7/1946 | Hunt | 261/39 C |
| 2,646,933 | 7/1953 | Boyce | 261/39 C |
| 2,694,559 | 11/1954 | Gordon et al. | |
| 2,774,343 | 12/1956 | Schaffer et al. | 261/39 C |
| 2,998,233 | 8/1961 | Marsee | 261/39 C |
| 3,161,787 | 12/1964 | VanSaan . | |
| 3,185,453 | 5/1965 | Mennesson . | |
| 3,227,428 | 1/1966 | Charron | 261/39 C |
| 3,237,927 | 3/1966 | Bickhaus . | |
| 3,284,061 | 11/1966 | Gordon | 261/39 C |
| 3,291,461 | 12/1966 | Pope . | |
| 3,494,598 | 2/1970 | Gordon | 261/39 B |
| 3,529,585 | 9/1970 | Stoltman | 261/39 C |
| 3,789,814 | 2/1974 | Gillham | 261/39 C |
| 3,806,854 | 4/1974 | Armstrong . | |
| 3,962,380 | 6/1976 | Cedar et al. | 261/39 B |
| 4,027,640 | 6/1977 | Hirosawa et al. . | |
| 4,050,424 | 9/1977 | Nelson . | |
| 4,050,427 | 9/1977 | Hollins . | |
| 4,083,336 | 4/1978 | Armstrong et al. . | |
| 4,096,837 | 6/1978 | Iiyama et al. . | |

FOREIGN PATENT DOCUMENTS

| | | |
|---|---|---|
| 2035462 | 6/1980 | United Kingdom . |

*Primary Examiner*—Tim R. Miles

*Attorney, Agent, or Firm*—James P. McAndrews; John A. Haug; Melvin Sharp

[57] ABSTRACT

A fuel supply system for an automotive engine has a thermal control regulating choke valve movement in a carburetor to provide smooth engine starting at various ambient temperatures while achieving improved fuel efficiency and pollution emission control. Motion transfer means in the control include cam, cam follower and gear means which are arranged between an electrically-heated, thermally-responsive spring and an additional spring to adapt the control to meet the performance requirements of a particular carburetor or engine. Movement of the thermally-responsive spring in response to temperature change moves the additional spring to provide any linear or non-linear changes in choke valve biasing force which may be desired for improving engine performance during engine warm up.

36 Claims, 4 Drawing Figures

FUEL SUPPLY SYSTEM WITH AUTOMATIC CHOKE

TECHNICAL FIELD

The field of this invention is that of fuel supply system for automobiles and the invention relates more particularly to such a system which is adapted to achieve improved engine performance and fuel efficiency and reduced emission of exhaust pollutants.

BACKGROUND OF THE INVENTION

Automotive fuel supply systems usually incorporate thermally responsive choke controls which regulate choke valve movement in a carburetor to improve engine starting at various ambient temperatures while also achieving improved fuel efficiency and improved pollution emission control. Such choke controls typically include a coil spring of thermostatic bimetal which is connected directly to an unbalance-mounted, air-movable choke valve. The thermostatic spring is selected so that when the engine is started and when engine vacuum tends to pull air into the carburetor to move the air-movable choke valve toward an open position, the spring resiliently biases the choke valve toward its closed position, thereby tending to provide a relatively richer fuel mixture to the engine. On a cold day, when a very rich fuel mixture is desired to permit smooth engine startup, the thermostatic spring provides a substantial force biasing the choke valve toward its closed position. However, on a warmer day, the spring responds to the higher ambient temperature and provides a relatively smaller choke valve biasing force as the engine is first started. In either event, the thermostatic spring is arranged to increase in temperature as the engine warms up to provide a progressively decreasing choke valve biasing force, thereby to permit a progressively leaner fuel mixture to be drawn into the engine to improve fuel efficiency and to reduce emission of unburned hydrocarbons and the like in the engine exhaust as warm up is achieved.

Many conventional choke controls incorporate electrically operable heaters which are energized to transfer heat to the thermostatic spring when engine operation is initiated. Such controls are adapted to provide strong, initial choke valve closing forces but permit the choke valve to be moved relatively rapidly to fully open position as the engine warms up. Other controls incorporate thermostatic switches which initiate operation of such heaters only when ambient temperature is above a selected level or only after a degree of engine warm-up has occurred. Such controls tend to provide a slow initial decrease in choke valve biasing force but then provide more rapid decrease in the force after the heater is energized to reduce pollution emission at the end of the warm-up cycle. Other controls use plural electrical heaters, one of which is operable by a thermostatic switch, to provide a slow but definite initial rate of change of choke valve biasing force on a cold day and to provide more rapid change in biasing force on a warm day or as engine warm-up nears completion. Other controls use hot air transfer means and the like to transfer heat to the thermostatic spring from the engine or use heat-conducting means to provide different heat transfer paths between plural heaters and the thermally responsive spring, thereby to provide the choke controls with particular performance characteristics as may be desired. Frequently however, considerable difficulty is experienced in trying to match the performance characteristics of a thermally responsive choke control to the requirements of a particular carburetor or engine under the different ambient temperature conditions likely to be encountered. Significant compromises often have to be made and, in any event, a considerable amount of design engineering effort is required to develop a choke control to meet the needs of each different carburetor or engine presently in use.

It is an object of this invention to provide a novel and improved automotive fuel supply system which achieves improved engine starting at various ambient temperatures while also achieving improved fuel efficiency and pollution emission control; to provide such a system which is adapted to meet the performance requirements of various different carburetors and engines; to provide such a system which is adapted to be easily modified to meet different performance requirements for different carburetors and engines; and to provide thermally responsive choke controls for use in such fuel supply systems.

BRIEF SUMMARY OF THE INVENTION

Briefly described, the novel and improved fuel supply system of this invention has a carburetor with an air-fuel induction passage for providing an air-fuel mixture to an automotive engine, an unbalance-mounted air-movable choke valve mounted for movement across the passage to regulate air flow into the passage, and thermal control means which are operatively connected to the choke valve for biasing the choke valve toward a position which restricts the entry of air into the passage with a force which decreases over a selected force range in response to increase in temperature over a selected temperature range. In accordance with this invention, the thermal control comprises a thermally responsive coil spring of thermostatic bimetal which is preferably mounted in a housing substantially enclosed in heat-sink means and which preferably has an elecrically-operable, self-regulating electrical resistance heater arranged to be actuated on initiation of engine operation to transfer heat to the thermally responsive spring. The spring is selected so that it is movable to a selected extent to develop a substantial degree of torque in response to change in temperature as the spring is cooled over a selected temperature range such as 75° F. to 0° F. An additional spring such as a monometal coil spring is also incorporated in the control and is arranged to apply a force to resiliently bias the choke valve toward a position which restricts the air flow into the carburetor passage. The additional spring means is mounted for movement to vary the choke valve biasing force over the selected force range noted above. Motion transfer means are incorporated in the control to be movable in response to movement of the thermally responsive spring as the spring temperature is increased over the selected temperature range, thereby to move the additional spring means to decrease the choke valve biasing force over the selected force range as the temperature change occurs. In that structure, the thermally responsive spring and the additional spring are easily selected and the motion transfer means are easily adapted so that movement of the thermally responsive spring can affect movement of the additional spring to bring about whatever changes in choke valve biasing force may be desired.

In the preferred embodiment of this invention, the motion transfer means include cam means which are mounted in the noted housing to be movable in response to movement of the thermally responsive spring. Cam follower means are also mounted in the housing to move as the cam means are moved, thereby to move the additional spring means for varying the choke valve biasing force as above described. In that way, the cam and cam follower means are easily selected to provide any desired variations in choke valve biasing force during engine warm-up.

In a preferred embodiment of the invention, the cam is provided with a cam surface having selected non-linear cam riser portions for providing the predetermined non-linear rate of change of choke valve biasing force which appears best adapted to meet the performance requirements of a particular carburetor or engine over the noted temperature range. In a preferred embodiment, the can follower means is also provided with gear means meshing with gear means operatively connected to the additional spring means, whereby a substantial movement of the additional spring can be achieved in response to a relatively more limited movement of the cam follower means.

In a preferred embodiment of the invention, the thermostatic coil spring means, heat-sink means, and electrically operable heater means as above described are disposed within an open end of the noted housing so that the center of the thermostatic spring is secured in place while a spring tang moves around the outer periphery of the spring as the spring temperature is varied. A cam member having a selected cam groove or surface is disposed in the open housing end to be rotated in response to such movement of the thermostatic spring. A housing frame is mounted in the open housing end over the cam and the additional coil spring is mounted on the outer side of the frame with its center connected to a shaft rotatable at the center of the frame. A spring tang at the outer periphery of the additional spring is operatively connected to the choke valve. A cam follower at the opposite side of the frame has an arm engaged with the cam groove or surface so that the cam follower is moved in response to cam movement. Gear means movable with the cam follower are meshed with corresponding gear means connected to the shaft mounting the additional coil spring. In that arrangement, movement of the thermally responsive spring in response to temperature change developes a substantial torque which is transmitted to the cam, the cam follower, and the gear means for moving the additional spring to vary choke valve biasing force in a desired manner.

DESCRIPTION OF THE DRAWINGS

Other objects, advantages and details of the fuel supply system and thermally responsive choke controls of this invention appear in the following detailed description of preferred embodiments of the invention, the detailed description referring to the drawings in which.

DESCRIPTION OF THE PREFERRED EMBODIMENTS

Figure 1:
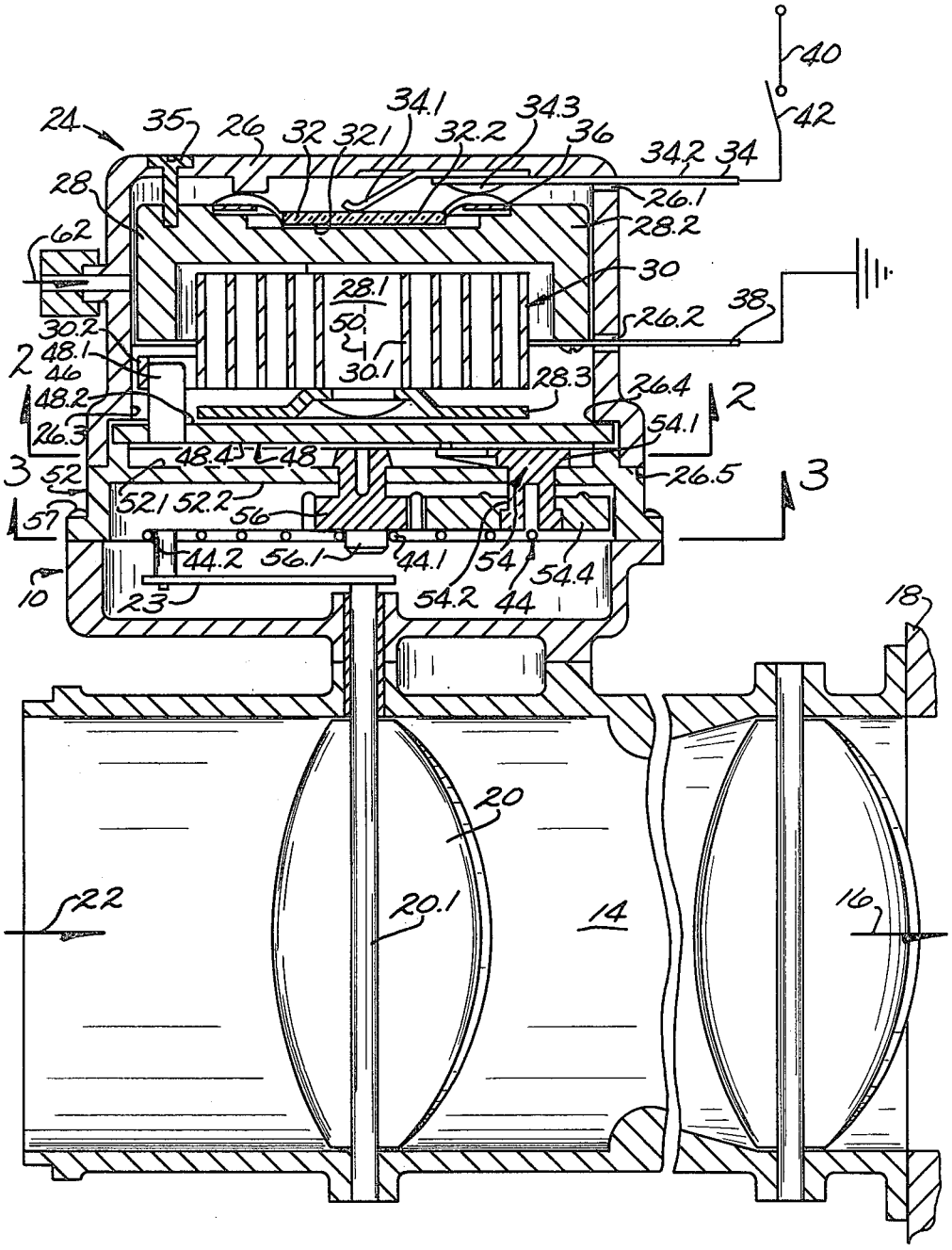
FIG. 1 is a diagrammatic section view along the principle axis of the fuel supply system provided by this invention.
Figure 2:
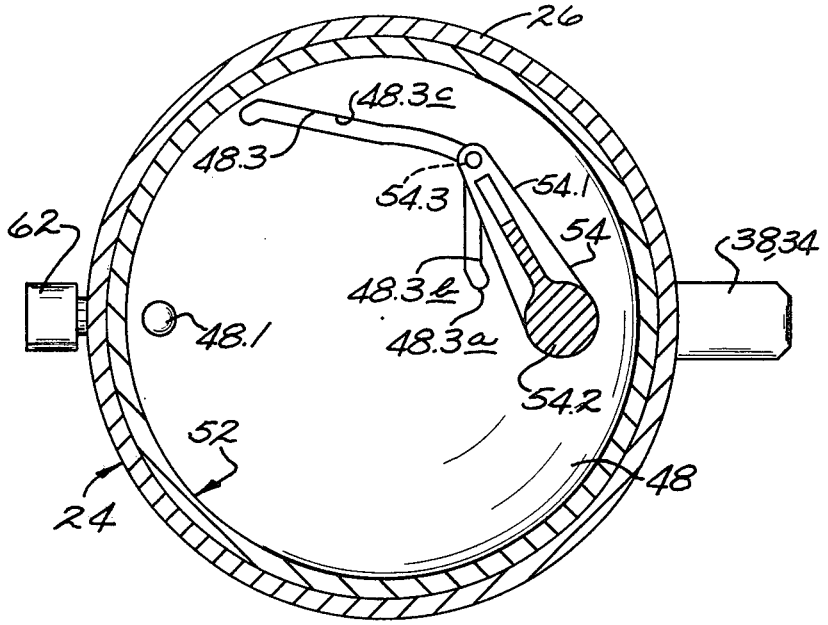
FIG. 2 is a section view along line 2—2 of FIG. 1.
Figure 3:
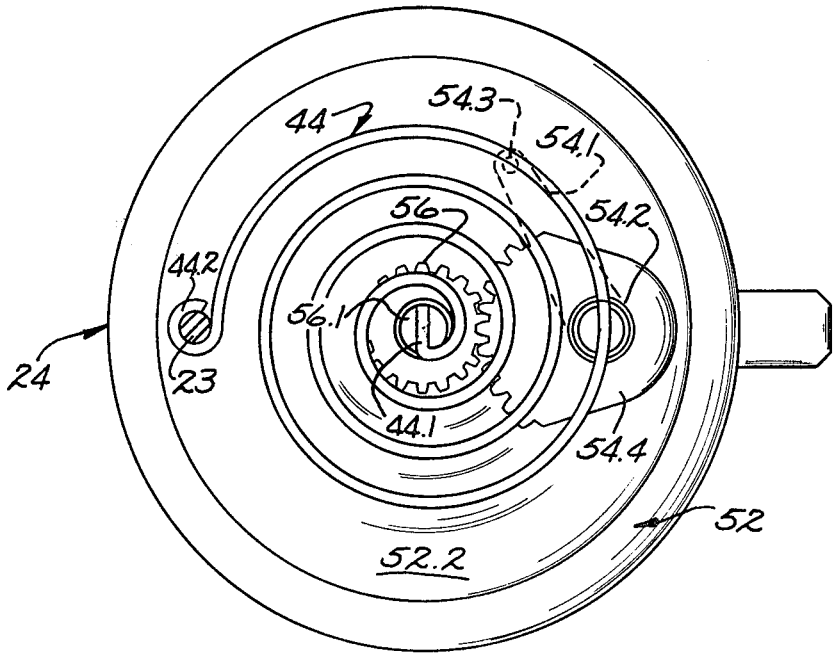
FIG. 3 is a section view along line 3—3 of FIG. 1.

Referring to the drawings, 10 in FIGS. 1–3 indicates the novel and improved fuel supply system of this invention which is shown to include a carburetor 12 having an air-fuel induction passage 14 for providing a mixture of air and fuel (as indicated by the arrow 16) to an internal combustion engine 18 of an automobile as is diagrammatically illustrated in FIG. 1. The system also includes an unbalance-mounted air-movable choke valve 20 which is movable across the passage 14 for regulating the entry of air into the passage. That is, the choke valve is unbalance-mounted on a shaft 20.1 so that the valve tends to be moved toward an open-passage position when air flows into the passage as indicated by the arrow 22 in FIG. 1. However, a bell crank 23 or the like is secured to the valve so that the valve can be moved to a closed position substantially restricting the entry of air into the passage 14. The system further incorporates a thermally responsive control 24 which is operatively connected to the bell crank as is shown in FIGS. 1–3 for regulating operation of the choke valve. As the carburetor, engine and choke valve are conventional, they are not further described herein and it will be understood that when the engine 18 is first started, engine vacuum tends to draw a mixture of air and fuel through the carburetor passage 14 into the engine and the flow of air into the passage as indicated by the arrow 22 tends to move the choke valve toward its open position in the passage to allow free entry of air into the passage. The thermal control 24 then regulates such movement of the choke valve as hereinafter described to achieve improved engine performance during engine start-up at various ambient temperatures while also improving fuel efficiency and reducing pollution emissions from the engine exhaust.

In accordance with this invention, the thermal control 24 includes a generally cup-shaped open-ended housing member 26 of a phenolic resin or glass-filled nylon or other strong and relatively rigid electrically insulating material or the like. A generally cup-shaped heat-sink member 28 formed of aluminum or other thermally and electrically conducting metal material or the like is disposed inside the housing cup 26 and is provided with a central stud 28.1 upstanding from the inner side of the heat sink bottom 28.2. A thermally responsive, spiral, coiled, thermostat metal spring 30 has one end 30.1 secured to stud 28.1 in any conventional manner and has a spring tank 30.2 at the opposite end of the spring which is adapted to move around the outer periphery of the spring when the bimetallic spring material coils and uncoils in response to temperature changes. The spring 30 is shown as a single layer of material in FIG. 1 to facilitate illustration but it will be understood that the spring is formed of thermostatic bimetal material which is preferably adapted to uncoil and to move the tank 30.2 to a selected extent in response to increase in spring temperature over a selected temperature range. Typically for example, the thermally responsive spring 30 is selected to move the spring tank 30.2 through an arc of about 80° as the spring temperature is increased from 0° F. to about 75° F. The typical spring 30 is also selected so that it has a torque rate of about 0.8 inch-ounces per angular degree of tang movement. Preferably a "top-hat" flange 28.3 of thermally-conducting metal or the like is secured to the stud 28.1 in the heat sink 28 as shown in FIG. 1 so that the thermally-responsive spring 30 is substantially enclosed in heat-sink material.

In a preferred embodiment of this invention, the thermal control 24 further includes heater means 32 which are arranged in heat-transfer relation to the thermally responsive spring 30. Preferably for example, the heater comprises a self-regulating electrical resistance heater such as a ceramic resistance heater unit of a material such as lanthanum-doped barium titanite or the like having a positive temperature coefficient of resistivity (PTC). One side 32.1 of the heater unit is secured in thermally and electrically conductive relation to the outer side of the bottom of the heat-sink 28. An electrical terminal 34 is arranged to electrically contact the opposite side 32.2 of the heater unit, thereby to electrically connect the heater in an electrical circuit. Preferably, the terminal 34 is provided with a resilient portion 34.1 at one end and is disposed inside the housing 26 so that an opposite end 34.2 of the terminal extends from the housing through an opening 26.1. The terminal is provided with a pad 34.3 of electrical insulating material and a wave spring 36 is disposed inside the housing to rest against that pad. The heat sink 28 with the spring 30 mounted therein is then disposed in the housing over the wave spring so that the heater side 32.2 is resiliently engaged by the terminal end 34.1. Preferably, screw means 35 or other conventional mounting means resiliently secure the heat-sink in place in the housing 26. A ground strip 38 or the like is secured in electrically conducting relation to the heat sink 28 in any conventional manner to extend from the housing 26 through a second opening 26.2. In that arrangement, the heater 32 is adapted to be electrically energized from the automotive battery power source or the like as is diagrammatically indicated at 40 in FIG. 1 when operation of the engine is initiated as is diagrammatically illustrated by closing of the ignition switch 42 in FIG. 1. The heater is also adapted to provide heat to the heat sink 28 and to transfer that heat to the thermally responsive spring 30. The heater unit is self-regulating in that it first supplies heat to the heat sink and to the spring 30 and then tends to stabilize at a selected elevated temperature for preventing overheating of the heater and for reducing power consumption of the heater to a very low level after temperature stabilization occurs.

In accordance with this invention, the thermal control 24 further includes an additional spring means 44 which is operatively connected to the choke valve 20 and which tends to resiliently bias the choke valve toward a closed position for substantially restricting air flow into the passage 14. The additional spring means 44 is mounted for movement to vary the biasing force applied to the choke valve over a selected force range. The thermal control also includes motion transmitting means 46 which are located between the thermally responsive spring 30 and the additional spring 44 for transmitting movement of the thermally responsive spring 30 to the additional spring 44. That is, the motion transfer means 46 are arranged so that movement of the spring 30 in response to said selected temperature change moves the additional spring 44 for varying the choke valve biasing force over said selected force range in any linear or non-linear manner which may be desired during such temperature change.

In a preferred embodiment of this invention for example, a cam disc 48 is disposed in the open end 26.3 of the control housing to rest rotatably on the housing shoulder 26.4. The disc has a pin 48.1 which depends from the cam disc side 48.2 to be engaged by the spring tang 30.2, whereby the cam disc is adapted to be rotated around the control axis 50 as the spring 30 coils or uncoils in response to temperature change. A selected cam surface 48.3, preferably embodied in a groove machined or molded in the disc, is provided in the opposite side 48.4 of the cam disc as is shown in FIGS. 1 and 2. A housing frame or cover 52 is secured over the open end of the housing by cementing to the shoulder 26.5 or in other conventional manner. A cam follower 54 has an arm 54.1 which is mounted on a shaft 54.2 for rotation with the shaft on the frame 52 at one side 52.1 of the frame. The cam follower arm 54.1 has a pin 54.3 depending from the distal end of the arm to extend into the cam disc groove to engage the cam surface 48.3. A gear segment 54.4 is secured to the shaft 54.2 for rotation with the shaft on the opposite side 52.2 of the frame as shown in FIGS. 1 and 3. An additional gear 56 meshed with the gear segment 54.4 is mounted on a second shaft 56.1 for rotation on the frame on said opposite side 52.2 of the frame. The additional spring 44 comprises a monometal spiral coil spring having one end 44.1 secured to the shaft 56.1 and has a tang 44.2 at its opposite end which moves around the outer periphery of the spring 44. The tang 44.2 is operatively engaged with the bell crank 20.1 so that the spring tends to resiliently bias the choke valve 20 toward its passage-closing position and so that coiling or uncoiling of the additional spring tends to vary that choke valve biasing force. In that structure, the frame member 52 substantially closes the open end of the control housing 26 to shield the PTC heater from the environment, positions the cam disc 48 for rotation in the control, and serves to mount the control on the carburetor 12 by the use of screw means 57 or another conventional manner.

In the fuel supply system 10 as thus far described, the spring 30 coils in response to a relatively low ambient temperature on a cool day to move the cam disc 48 in a counterclockwise direction (as viewed in FIG. 2) so that the cam occupies a position as shown in FIG. 2. The cam movement moves the cam follower 54 to a corresponding position as the cam surface 48.3 engages the pin 54.3. The gear segment 54.4 therefore rotates in meshed engagement with the gear 56 so that the spring 44 is also coiled in counterclockwise direction. In that way, the spring 44 applies a force which resiliently biases the choke valve to a relatively closed position in the passage 14. Accordingly, when operation of the engine 18 is first initiated with closing of the ignition switch 42, the biasing force of the spring 44 on the choke valve restricts air entry into the passage so that the carburetor provides a relatively rich air-fuel mixture 16 to the engine to assure smooth engine operation during engine starting despite the low ambient temperature. However, the closing of the switch 42 also energizes the heater 32 which promptly increases the temperature of the spring 30 so that the spring uncoils and moves the cam disc 48 in a clockwise direction. That cam movement engages the cam surface 48.3 with the cam follower pin 54.3 and moves the follower with its associated gear means to reduce the choke valve biasing force applied by the spring 44. In that way, the choke valve moves more freely in response to the air flow 22 and the carburetor therefore provides a leaner air-fuel mixture 16 to the engine as engine warm-up is completed.

In the structure as shown, the spring 30 is easily selected so that the tang 30.2 moves through a selected arc as the temperature of the spring is increased through a selected temperature range such as 0° F. to 75° F. The spring 30 is also easily selected so that it provides a substantial torque in response to such temperature changes, whereby the spring is adapted to freely move the motion transmitting means 46 as above described and to overcome any frictional forces and the like tending to restrict such movement. The additional spring 44 is also easily selected so that coiling or uncoiling movement of the spring is adapted to vary the choke valve biasing force over the selected force range which is deemed desirable for meeting the performance requirements of the carburetor 12 or the engine 18. Typically for example, the additional spring has a torque rate of about 0.1 inch-ounces per angular degree of tang movement. The cam 48 is also easily provided with a cam surface 48.3 which easily converts a particular rate of movement of the thermally responsive spring 30 into a desired rate of change in the choke valve biasing force applied by the spring 44. Typically, the cam is selected so that the overall movement of the spring 44 is about twice that of the spring 30. In that way, the thermal control is easily adapted to regulate choke valve operation to suit the performance requirements of the carburetor or engine.

For example, in one preferred embodiment of the invention, the cam surface 48.3 is proportioned so that the cam follower pin 54.3 is positioned at the end 48.3 *a* of the cam surface when the ambient temperature is on the order of 0° F. The end 48.3 *a* of the cam surface is disposed close to the control axis 50 so that the spring 44 provides a very strong choke valve biasing force to furnish a very rich air-fuel mixture to the engine as engine operation is initiated. The cam surface is then provided with a first cam riser portion 48.3 *b* having a relatively fast rate of rise such that, as the temperature of the spring 30 is first increased by the heater 32, the choke valve biasing force is rapidly reduced to much lower level. In that way, a very rich mixture is provided to permit prompt engine starting but that mixture is rapidly reduced for reducing pollution emissions. The cam surface is then provided with another cam riser portion 48.3 *c* with a relatively lower rate of rise which progressively reduces the choke valve biasing force as the engine continues to warm up. That later movement of the choke valve gradually achieves improved fuel efficiency and further reduces pollution emissions but does not result in such a lean mixture as might cause rough engine operation before adequate engine warm up has occurred. Such operation of the fuel supply system is diagrammatically indicated by the curve 60 in the graph of FIG. 4 A with the rate of change of choke valve biasing effected by the cam riser portions 48.3 *b* and 48.3 *c* being indicated in the graph.

Figure 4A:
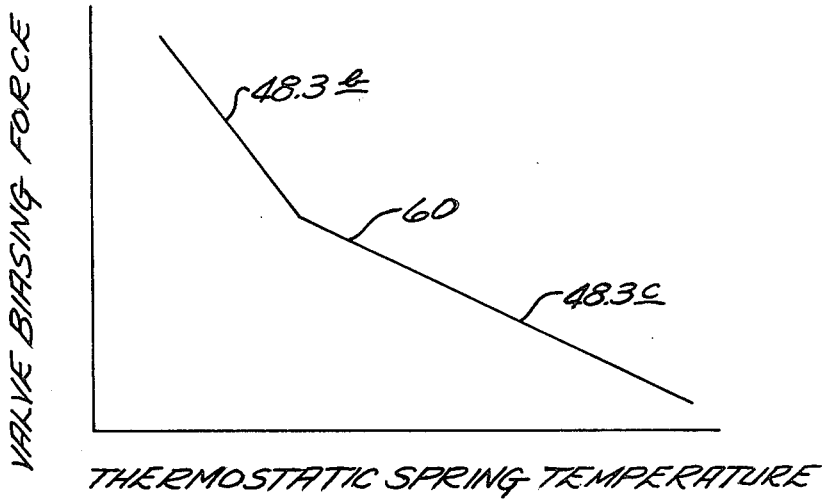
FIG. 4 is a graph diagrammatically illustrating the performance characteristics of two alternate embodiments of this invention.
Figure 4B:
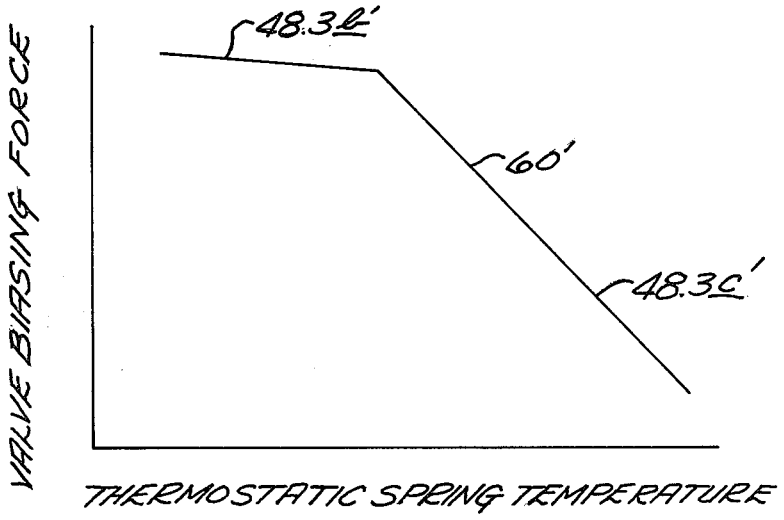

In an alternate embodiment of the invention, the cam disc of the thermal control has a cam riser portion 48.3 $b^1$ provided with a rate of rise which is slow relative to the rate of rise of a cam riser portion 48.3 $c^1$ as is diagrammatically illustrated by curve $60^1$ in FIG. 4 B. In that alternate fuel supply system, the choke valve biasing force is maintained at a high level as indicated at 48.3 $b^1$ in FIG. 4 B until sufficient engine warm up has occurred to assure smooth engine starting. The choke valve biasing force is then rapidly reduced as indicated at 48.3 $c^1$ in FIG. 4 B as the temperature of the thermally responsive control spring increases for rapidly improving fuel efficiency and reducing exhaust pollution emission. As will be understood, the cam surface 48.3 can be provided with any linear or non-linear cam riser portions as may be desired for converting any selected motion of the thermally responsive spring 30 in response to a selected temperature change to produce any desired rate of change of choke valve biasing force applied by the spring 44. The cam surface can also be selected to compensate for such factors as non-linearity of the rate of movement of the thermally responsive spring in response to a selected temperature change and non-linearity in the heating effect of the heater 32 with respect to the spring 30. The interposition of the motion transmitting means 46 between the thermally responsive spring 30 and the choke valve biasing spring 44 also permits a relatively strong thermally responsive spring to provide smooth control operation while a relatively lighter spring 44 provides the desired range of choke valve biasing forces. Typically, the thermally responsive spring is adapted to provide five to ten times the torque forces provided by the spring 44 in its normal range of operation. The ratio of the gear means 54.3 and 56 also permit relatively limited movement of the cam follower 54 to provide relatively substantial coiling movement of the choke valve biasing spring 44.

It will be understood that although particular embodiments of the fuel supply system and thermal choke control of this invention have been described by way of illustrating the invention, many modifications of the described embodiments are possible within the scope of the invention. For example, if desired, air which has been heated by the engine 18 during warm up can be directed onto the thermally responsive spring 30 in any conventional manner as is diagrammatically illustrated by the arrow 62 in FIG. 1. Further, although the thermal control 24 is shown to embody only a single heater 32, more than one heater could be used in any conventional manner. Similarly, thermostatic switches could be incorporated in the control for initiating operation of one or more of such plural heaters only when a control is above a selected ambient temmperature or only after the control spring 30 has been heated to a selected extent. Further, the heat-sink means 28 could be adapted to provide heat transfer paths of different lengths between such plural heaters and the thermally responsive control spring 30. It will be understood that this invention includes all modifications and equivalence of the disclosed embodiments falling within the scope of the appended claims.

We claim:

1. A fuel supply system having a carburetor with an air-fuel induction passage for providing a mixture of air and fuel to an automotive engine, an unbalance-mounted air-movable choke valve mounted for movement across the passage to regulate air-flow into the passage, and thermal control means operatively connected to the choke valve for biasing the choke valve toward a position restricting air flow into the passage with a force which decreases over a selected force range in response to increase in temperature over a selected temperature range, characterized in that the thermal control means comprises thermally responsive coil spring means movable to a selected extent in response to increase in temperature of the thermally responsive spring means over said selected temperature range, additional spring means applying a force to resiliently bias the choke valve toward said air flow restricting position, the additional spring means being movable for varying the choke valve biasing force over said selected force range, and motion transfer means responsive to movement of the thermally responsive spring means in response to said increase in temperature over said selected temperature range to move the additional spring means to decrease said choke valve biasing force over said selected force range, the motion transfer means comprising cam means movable with one of said spring means and cam follower means movable with the other of said spring means, the cam means having a cam surface with a plurality of sloped cam riser portions cooperating with the cam follower means to provide progressive movements of the cam follower means during respective portions of the movement of the thermally responsive spring means as the temperature of the thermally responsive spring means is increased over said selected temperature range in response to engine warm up, thereby to provide selected non-linear and progressive changes in choke valve biasing force during the engine warm up.

2. A fuel supply system as set forth in claim 1 further characterized in that the sloped cam riser portions and cam follower means cooperate in providing a relatively fast initial progressive decrease in choke valve biasing force followed by a second relatively slower progressive decrease in choke valve biasing force in response to a pre-determined rate of increase in temperature of the thermally responsive spring means over said selected temperature range.

3. A fuel supply system as set forth in claim 1 further characterized in that the sloped cam riser portions and the cam follower means cooperate in providing a relatively slow initial progressive decrease in choke valve biasing force and in thereafter providing a relatively faster progressive decrease in choke valve biasing force in response to a predetermined rate of increase in temperature of the thermally responsive spring means over said selected temperature range.

4. A fuel supply system as set forth in claim 1 further characterized in that said cam means is detachably mounted in said thermal control means for permitting easy replacement thereof with corresponding cam means to adapt the control to provide other selected non-linear and progressive changes in choke valve biasing force when the system is used for providing a mixture of air and fuel to another automotive engine.

5. A fuel supply system as set forth in claim 1 having heater means actuable on initiation of operation of said engine for promptly heating the thermally responsive spring means to the upper limit of said selected temperature range.

6. A fuel supply system as set forth in claim 5 further characterized in that said heater means include means transferring heat from said automotive engine to the thermally responsive spring means after initiation of engine operation.

7. A fuel supply system as set forth in claim 5 further characterized in that said heater means include a self-regulating electrically operable heater disposed in heat-transfer relation to the thermally responsive spring means.

8. A fuel supply system as set forth in claim 7 further characterized in that heat sink means receive heat from said heater for transferring the heat to the thermally responsive spring means.

9. A fuel supply system having a carburetor with an air-fuel induction passage for providing a mixture of air and fuel to an automotive engine, an unbalance-mounted air-movable choke valve mounted for movement across the passage to regulate air-flow into the passage, and thermal control means operatively connected to the choke valve for biasing the choke valve toward a position restricting air flow into the passage with a force which decreases over a selected force range in response to increase in temperature over a selected temperature range, characterized in that the thermal control means comprises thermally responsive coil spring means movable to a selected extent in response to increase in temperature of the thermally responsive spring means over said selected temperature range, additional spring means applying a force to resiliently bias the choke valve toward said air flow restricting position, the additional spring means being movable for varying the choke valve biasing force over said selected force range, motion transfer means responsive to movement of the thermally responsive spring means in response to said increase in temperature over said selected temperature range to move the additional spring means to decrease said choke valve biasing force over said selected force range, the motion transfer means comprising cam means having a selected cam surface movable in response to said movement of the thermally responsive spring means and cam follower means movable in response to movement of the cam means for moving the additional spring means to provide a selected non-linear rate of change of the choke valve biasing force during engine warm up, and ratio changing means which respond to said movement of the cam follower means for providing a first degree of movement of the additional spring means in response to a second degree of movement of the cam follower means.

10. A fuel supply system as set forth in claim 9 further characterized in that the ratio changing means comprise gear means operatively connected to the cam follower means and to the additional spring means.

11. A fuel supply system having a carburetor with an air-fuel induction passage for providing a mixture of air and fuel to an automotive engine, an unbalance-mounted air-movable choke valve mounted for movement across the passage to regulate air-flow into the passage, and thermal control means opertively connected to the choke valve for biasing the choke valve toward a position restricting air flow into the passage with a force which decreases over a selected force range in response to increase in temperature over a selected temperature range, characterized in that the thermal control means comprises housing means, thermally responsive coil spring means mounted on the housing means for movement to a selected extent in response to increase in temperature of the thermally responsive spring means over said selected temperature range, the thermally responsive spring means being mounted on the housing means to be movable in response to changes in ambient temperature within said selected temperature range, cam means mounted on the housing means for movement in response to movement of the thermally responsive spring means, frame means mounted on the housing means, additional spring means mounted on the frame means to apply a force to resiliently bias the choke valve toward said air flow restricting position, the additional spring means being movable for varying the choke valve biasing force over said selected force range, cam follower means mounted on the frame means to be responsive to movement of the cam means in response to said increase in temperature over said selected temperature range to move the additional spring means to decrease said choke valve biasing force over said selected force range for originally applying a first biasing force to the choke valve corresponding to ambient temperature when engine operation is first initiated, and heater means actuable on initiation of operation of the engine for heating the thermally responsive spring means where required to the upper limit of said selected temperature range to fully decrease said choke valve biasing force to the limit of said force range.

12. A fuel supply system as set forth in claim 11 further characterized in that said additional spring means comprise coil spring means mounted on a shaft for movement in response to rotation of the shaft, first gear means moveable with said cam follower means, and several gear means on a shaft responsive to movement of the first gear means for rotation on the shaft.

13. A fuel supply system as set forth in claim 11 further characterized in that said heater means comprises heat sink means substantially surrounding the thermally responsive spring means within said housing means in heat-transfer relation to the thermally responsive spring means, and self-regulating electrical resistance heater means of a positive temperature coefficient of resistivity mounted on the heat sink means in heat-transfer relation thereto to be electrically actuated in response to initiation of operation of said automotive engine.

14. A fuel supply system as set forth in claim 11 further characterized in that said cam means has a cam riser surface with non-linear rates of rise over various portions of the surface cooperating with the cam follower means to provide a non-linear rate of change of said choke valve biasing force during normal actuation of the heater means after initiation of engine operation.

15. A fuel supply system as set forth in claim 14 further characterized in that said cam surface has a first riser portion with a relatively fast rate of rise, and has an additional riser portion with a relatively slower rate of rise.

16. A fuel supply system as set forth in claim 14 further characterized in that said cam surface has a first riser portion with a relatively slow rate of rise and an additional riser portion with a relatively faster rate of rise.

17. A fuel supply system as set forth in claim 11 further characterized in that said thermally responsive spring means has a relatively greater torque rate than said additional spring means for assuring free operation of the thermal control means.

18. A fuel supply system as set forth in claim 17 further characterized in that said thermally responsive spring means has a torque rate in the range from five to ten times greater than the torque rate of the additional spring means for reducing any variation in choke valve biasing force which might be due to frictional forces tending to retard choke valve movement.

19. A thermally responsive choke control for a carburetor having an air-fuel passage for providing a mixture of air and fuel to an automotive engine and having a choke valve movable across the passage for regulating air flow into the passage, the control comprising thermally responsive coil spring means movable to a selected extent in response to increase in temperature of the coil spring means over a selected temperature range, additional spring means for applying a force to resiliently bias the choke valve toward a position restricting air flow into the passage, the additional spring means being movable for varying the choke valve biasing force over a selected force range, and motion transfer means responsive to movement of the thermally responsive spring means in response to increase in temperature over said selected temperature range to move the additional spring means to decrease the choke valve biasing force over said selected force range, the motion transfer means comprising cam means movable with one of said spring means and cam follower means movable with the other of said spring means, the cam means having a cam surface with a plurality of sloped cam riser portions cooperating with the cam follower means to provide progressive movements of the cam follower means during respective portions of the movement of the thermally responsive spring means as the temperature of the thermally responsive spring means in increased over said selected temperature range in response to engine warm up to thereby provide selected non linear and progressive changes in choke valve biasing force during the engine warm up.

20. A control as set forth in claim 19 further characterized in that the sloped cam riser portions and the cam follower means cooperate in providing a relatively fast initial progressive decrease in choke valve biasing force followed by a second relatively slower progressive decrease in choke valve biasing force in response to a predetermined rate of increase in temperature of the thermally responsive spring means over said selected temperature range.

21. A control as set forth in claim 19 further characterized in the the sloped cam riser portions and the cam follower means cooperate in providing a relatively slow initial progressive decrease in choke valve biasing force and in thereafter providing a relatively faster progressive decrease in choke valve biasing force in response to a predetermined rate of increase in temperature of the thermally responsive spring means over said selected temperature range.

22. A control as set forth in claim 19 wherein said cam means is detachably mounted in the control for permitting easy replacement thereof with corresponding cam means to adapt the control to provide other selected non-linear and progressive changes in choke valve biasing force when the control is to be used for providing a mixture of air and fuel to another automotive engine.

23. A control as set forth in claim 19 having heater means actuable on initiation of operation of said engine for promptly heating the thermally responsive spring means to the upper limit of said selected temperature range.

24. A control as set forth in claim 23 further characterized in that said heater means include means for transferring heat from said automotive engine to the thermally responsive spring means after initiation of engine operation.

25. A control as set forth in claim 23 further characterized in that said heater means include a self-regulating electrically operable heater disposed in heat-transfer relation to the thermally responsive spring means.

26. A control as set forth in claim 25 further characterized in that heat sink means receive heat from said heater for transferring the heat to the thermally responsive spring means.

27. A thermally responsive choke control for a carburetor having an air-fuel passage for providing a mixture of air and fuel to an automotive engine and having a choke valve movable across the passage for regulating air flow into the passage, the control comprising thermally responsive coil spring means movable to a selected extent in response to increase in temperature of the coil spring means over a selected temperature range, additional spring means for applying a force to resiliently bias the choke valve toward a position restricting air flow into the passage, the additional spring means being movable for varying the choke valve biasing force over a selected force range, motion transfer means responsive to movement of the thermally responsive spring means in response to increase in temperature over said selected temperature range to move the additional spring means to decrease the choke valve biasing force over said selected force range, the motion transfer means comprising cam means having a selected cam surface movable in response to said movement of the thermally responsive spring means and cam follower means movable in response to movement of the cam means for moving the additional spring means to provide a selected non-linear rate of change of the choke valve biasing force during engine warm up, and ratio changing means respond to said movement of the cam follower means for providing a first degree of movement of the additional spring means in response to a second degree of movement of the cam follower means.

28. A control as set forth in claim 27 further characterized in that the ratio changing means comprise gear means operatively connected to the cam follower means and to the additional spring means.

29. A thermally-responsive control for a carburetor having an air-fuel induction passage for providing a mixture of air and fuel to an automotive engine and having an unbalance-mounted air-movable choke valve mounted for movement across the passage to regulate air-flow into the passage, the thermal control means being adapted to be operatively connected to the choke valve for biasing the choke valve toward a position restricting air flow into the passage with a force which decreases over a selected force range in response to increase in temperature over a selected temperature range, characterized in that the thermal control means comprises housing means, thermally responsive coil spring means mounted on the housing means for movement to a selected extent in response to increase in temperature of the thermally responsive spring means over said selected temperature range, the thermally responsive spring means being mounted on the housing means to be movable in response to changes in ambient temperature within said selected temperature range, cam means mounted on the housing means for movement in response to movement of the thermally responsive spring means, frame means mounted on the housing means, additional spring means mounted on the frame means to apply a force to resiliently bias the choke valve toward said air flow restricting position, the additional spring means being movable for varying the choke valve biasing force over said selected force range, cam follower means mounted on the frame means to be responsive to movement of the cam means in response to said increase in temperature over said selected temperature range to move the additional spring means to decrease said choke valve biasing force over said selected force range for originally applying a first biasing force to the choke valve corresponding to ambient temperature when engine operation is first initiated, and heater means actuable on initiation of operation of the engine for heating the thermally-responsive spring means where required to the upper limit of said selected temperature range to fully decrease said choke valve biasing force to the limit of said force range.

30. A control as set forth in claim 29 further characterized in that said additional spring means comprise coil spring means mounted on a shaft for movement in response to rotation of the shaft, first gear means movable with said cam follower means, and second gear means on a shaft responsive to movement of the first gear means for rotating on the shaft.

31. A control as set forth in claim 29 further characterized in that said heater means comprises heat sink means substantially surrounding the thermally responsive spring means within said housing means in heat-transfer relation to the thermally responsive spring means, and self-regulating electrical resistance heater means of a positive temperature coefficient of resistivity mounted on the heat sink means in heat-transfer relation thereto to be electrically actuated in response to initiation of operation of said automotive engine.

32. A control as set forth in claim 29 further characterized in that said cam means has a cam riser surface with non-linear rates of rise over various portions of the surface cooperating with the cam follower means to provide a non-linear rate of change of said choke valve biasing force during normal actuation of the heater means after initiation of engine operation.

33. A control as set forth in claim 32 further characterized in that said cam surface has a first riser portion with a relatively fast rate of rise, and has an additional riser portion with a relatively slower rate of rise.

34. A control as set forth in claim 32 further characterized in that said cam surface has a first riser portion with a relatively slow rate of rise and an additional riser portion with a relatively faster rate of rise.

35. A control as set forth in claim 29 further characterized in that said thermally responsive spring means has a relatively greater torque rate than said additional spring means for assuring free operation of the thermal control means.

36. A control as set forth in claim 35 further characterized in that said thermally responsive spring means has a torque rate in the range from five to ten times the torque rate of the additional spring means over said selected temperature range for reducing any variation in choke valve biasing force which might be due to frictional forces tending to retard movement of the choke valve.

* * * * *